US009358790B2

(12) United States Patent
Ohnishi

(10) Patent No.: US 9,358,790 B2
(45) Date of Patent: Jun. 7, 2016

(54) PRINTING APPARATUS AND LANDING POSITION DETERMINATION METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/503,423

(22) Filed: Oct. 1, 2014

(65) Prior Publication Data

US 2015/0097886 A1 Apr. 9, 2015

(30) Foreign Application Priority Data

Oct. 7, 2013 (JP) ..... 2013-210241

(51) Int. Cl.
*B41J 2/21* (2006.01)
*B41J 2/165* (2006.01)

(52) U.S. Cl.
CPC ..... *B41J 2/16517* (2013.01); *B41J 2/16579* (2013.01); *B41J 2/2135* (2013.01); *B41J 2/2139* (2013.01); *B41J 2/2142* (2013.01)

(58) Field of Classification Search
CPC ..... B41J 29/393; B41J 25/308; B41J 2/2135; B41J 2/04573; B41J 11/0035; B41J 2/04505; B41J 2/04556; B41J 2/0458; B41J 11/42; B41J 2029/3935; B41J 2/2139; B41J 2/2142; B41J 2/16517; B41J 2/16579
See application file for complete search history.

(56) References Cited

U.S. PATENT DOCUMENTS 8,342,630 B2 * 1/2013 Uchida et al. ..... 347/14
2010/0053675 A1 3/2010 Nobuta et al.

OTHER PUBLICATIONS

"1st Office Action of China Counterpart Application", issued on Sep. 29, 2015, p. 1-p. 12, with English translation thereof.

* cited by examiner

*Primary Examiner* — Thinh Nguyen
(74) *Attorney, Agent, or Firm* — Jianq Chyun IP Office

(57) ABSTRACT

A printing apparatus which performs printing by using an ink jet method includes an ink jet head including nozzles which eject ink droplets on a medium, a landing position reading unit which reads a landing position which is a position on which ink droplets are landed on the medium, and a landing state determination unit which determines whether or not a landing position is deviated from a normal position which is set in advance based on a landing position which is read by using the landing position reading unit.

16 Claims, 7 Drawing Sheets

PRINTING APPARATUS AND LANDING POSITION DETERMINATION METHOD

CROSS REFERENCE TO RELATED APPLICATIONS

This application claims the priority benefit of Japanese application serial no. 2013-210241, filed on Oct. 7, 2013. The entirety of the above-mentioned patent application is hereby incorporated by reference herein and made a part of specification.

TECHNICAL FIELD

The present invention relates to a printing apparatus, and a landing position determination method.

DESCRIPTION OF THE BACKGROUND ART

In the related art, an ink jet printer which performs ink jet printing has been widely used. The ink jet printer performs printing by ejecting ink droplets from nozzles in an ink jet head (for example, refer to Internet URL http://www.mimaki-.co.jp).

SUMMARY

In an ink jet printer, there is a case in which a printing quality is influenced by an uneven ejecting property of nozzles. For example, in the ink jet printer, there is a case in which ejection abnormality (flying astray or the like) in which a landing position of ink droplets is deviated occurs when foreign matter or solidified ink is attached in the vicinity of nozzles of the ink jet head, or the like. In addition, there is a concern that a printing quality may deteriorate when printing is performed in a state in which a landing position is deviated. For this reason, in the related art, it is desired that, when a deviation of ink droplets in a landing position occurs, the deviation is to be detected by using a simple and appropriate method. Therefore, an object of the present invention is to provide a printing apparatus and a landing position determination method which can solve the problem.

In order to solve the above problem, the present invention has the following configuration.

First Configuration

According to an aspect of the present invention, there is provided a printing apparatus which performs an ink jet printing, and the printing apparatus includes: an ink jet head, including nozzles which eject ink droplets toward a medium; a landing position reading unit, which reads a landing position, and the landing position is a position on the medium where ink droplets are landed; and a landing state determination unit, which determines whether or not the landing position is deviated from a normal position which is set in advance, based on the landing position which is read by using the landing position reading unit.

With such a configuration, when a deviation in the landing position occurs, for example, it is possible to appropriately detect the deviation. In addition, in this manner, it is possible to appropriately prevent a printing quality from being influenced by an uneven ejecting property of nozzles. In addition, for example, it is possible to perform maintenance such as nozzle cleaning (nozzle recovering process such as wiping of nozzle face of ink jet head, suctioning, or the like) as necessary. In addition, in this manner, it is possible to recover the nozzle so as to be in a normal state by eliminating a foreign substance, or the like, which is attached to a position of the nozzle. In addition, for example, it is also possible to take into consideration a nozzle recovery process, such as performing printing by using another normal nozzle instead of a defective nozzle.

In addition, in a landing position of ink droplets, when the position is deviated from a normal position, it means that the position is deviated from a position in a predetermined range about a standard landing position which is determined in design, for example. In addition, maintenance of the ink jet head can be automatically performed when a deviation in landing position is detected, for example. In addition, maintenance, or the like, may be performed according to a received instruction by receiving an instruction of a user, by performing, for example, a display of errors or warnings (alarm prompting exchange of head) without automatically performing maintenance. In addition, for example, when a nozzle state is not recovered even when performing maintenance a predetermined number of times, performing a display of errors, warnings, or the like also can be taken into consideration. In addition, for example, when it is possible to recover the nozzle so as to be in a normal state due to correction of a driving signal which is a signal for ejecting ink droplets from the nozzle, performing of a correction of the driving signal is also taken into consideration.

In addition, when the driving signal is corrected, it is possible to take into consideration a case in which the correction is performed in a unit of one nozzle, for example. With such a configuration, for example, it is possible to individually and further appropriately correct the driving signal with respect to each nozzle. In addition, the correction of the driving signal may be performed in a unit of group of nozzles including a plurality of the nozzles, respectively, and in each group. With such a configuration, for example, it is possible to more simply correct the driving signal. In addition, it is preferable to check a state after the correction by performing printing again, after the correction of the driving signal. In addition, when the state after the correction does not fall in a certain error range, it is preferable to perform a correction of the driving signal again. It is possible to appropriately improve correction precision by repeatedly performing these operations.

Second Configuration

In the aspect, the ink jet head may eject ink droplets toward the medium from the nozzles by performing a main scanning operation in which ink droplets are ejected, while moving in a main scanning direction which is set in advance, and the ink jet head may draw lines or dots on the medium by ejecting ink droplets from the nozzles, by performing the main scanning operation at a time of determining the landing position in which the landing state determination unit is caused to make a determination on the landing position. The landing position reading unit may read a position of the lines or the dots as the landing position, by correlating the position of the lines or dots with the nozzle which draws the lines or dots, and the landing state determination unit may determine whether or not the landing position of the nozzle which draws the lines or dots is deviated from the normal position based on the position of the lines or dots which is read by using the landing position reading unit. With such a configuration, for example, it is possible to appropriately detect a deviation in landing position in a printing apparatus which performs printing by performing a main scanning operation.

Third Configuration

In the aspect, the landing position reading unit may read the position of the lines or dots in the main scanning direction as the landing position, and the landing state determination unit may determine whether or not the landing position in the main scanning direction is deviated from the normal position with respect to the nozzle which draws the lines or dots, based on the position of the lines or dots which is read by using the landing position reading unit. With such a configuration, for example, it is possible to appropriately detect a deviation in landing position in the main scanning direction.

Fourth Configuration

In the aspect, the ink jet head may include a plurality of nozzles which align in a sub-scanning direction which is orthogonal to the main scanning direction, and the ink jet head may draw a plurality of lines or dots which align in the sub-scanning direction on the medium by drawing the lines or dots on the medium using each of the plurality of nozzles aligning in the sub-scanning direction at a time of determining the landing position. The landing position reading unit may read positions of each of the plurality of lines or dots in the main scanning direction by correlating the positions with each of the nozzles which draws the lines or dots, and the landing state determination unit may determine whether or not the landing position in the main scanning direction is deviated from the normal position with respect to each of the nozzles which draws the lines or dots, by comparing each of the positions of the plurality of lines or dots with the others based on the positions of the plurality of lines or dots which are read by the landing position reading unit in the main scanning direction.

When being configured in this manner, for example, it is possible to simply and appropriately detect a deviation in landing position of ink droplets in the main scanning direction, by detecting a position which is deviated in the main scanning direction compared to another line or dot with respect to the plurality of lines or dots which are aligned in the sub-scanning direction. For this reason, with such a configuration, when a deviation in landing position in the main scanning direction in any of the nozzles occurs with respect to the plurality of nozzles which are aligned in the sub-scanning direction, for example, it is possible to simply and appropriately detect the deviation.

In addition, at a time of determining a landing position, the ink jet head may select some nozzles among all of the nozzles as a plurality of nozzles which draw lines or dots at the same time during a main scanning operation. In this case, for example, by sequentially changing the plurality of nozzles which are selected at the same time, whether or not a landing position in the main scanning direction is deviated from the normal position is determined with respect to the entire nozzles.

Fifth Configuration

In the aspect, the ink jet head may draw a straight line which extends in the main scanning direction by ejecting ink droplets from the nozzles using a main scanning operation at the time of determining a landing position. The landing position reading unit may read a position of the straight line in the sub-scanning direction which is orthogonal to the main scanning direction as the landing position, and the landing state determination unit may determine whether or not the landing position in the sub-scanning direction is deviated from the normal position with respect to the nozzle which draws the straight line, based on the position of the straight line which is read by using the landing position reading unit. With such a configuration, it is possible to appropriately detect a deviation in landing position in the sub-scanning direction, for example.

In addition, at the time of determining a landing position, the ink jet head draws a plurality of straight lines which align in the sub-scanning direction, by using a plurality of nozzles which align in the sub-scanning direction, for example. In this case, the landing state determination unit determines whether or not the landing position in the sub-scanning direction is deviated from the normal position with respect to respective nozzles which draw straight lines, by calculating an interval between straight lines (pitch) in the sub-scanning direction with respect to the plurality of straight lines which align in the sub-scanning direction, for example.

Sixth Configuration

In the aspect, a line width measuring unit which measures a line width of a line which is drawn on a medium at the time of determining the landing position may be further included, and the landing state determination unit may further determine whether or not the line width which is measured by using the line width determination unit is in a range of a standard which is set in advance.

In the ink jet printer, for example, there also is a case in which ejection abnormality occurs in which a size of ink droplets (capacity, or ink volume) which are ejected from nozzles becomes uneven. In addition, when such ejection abnormality occurs, a case in which density unevenness, or the like, occurs in a recorded image is taken into consideration.

In contrast to this, the inventor of the present application has found that it is possible to appropriately check a size of ink droplets which are ejected from each nozzle by measuring a line width of a line which is drawn using each nozzle of the ink jet head through an enthusiastic research work. For this reason, with such a configuration, it is possible to simply and appropriately detect ejection abnormality in which a size of ink droplets becomes uneven, in addition to a deviation in landing position of ink droplets, for example. In addition, in this manner, it is possible to appropriately prevent a printing quality from being influenced by the uneven ejecting property of the nozzle, or the like.

In addition, the line width measuring unit can be configured by sharing a sensor which is used as the landing position reading unit, for example. In addition, it is preferable that the printing apparatus further include a signal correction unit which corrects a driving signal which is supplied to each nozzle. In this case, when a line width which is measured by the line width measuring unit is determined not to be in a range of the standard which is set in advance by the line width measuring unit, for example, the signal correction unit adjusts a size of ink droplets by correcting a driving signal which is supplied to a nozzle which draws the line.

Seventh Configuration

In the aspect, the ink jet head may include a plurality of nozzles which align in the sub-scanning direction which is orthogonal to the main scanning direction, and the ink jet head may draw lines or dots on a medium by using selected nozzles which are a part of nozzles selected from the plurality of nozzles at the time of determining a landing position, the selected nozzles may be selected so as to interpose at least one or more non-selected nozzles therebetween in the nozzle column direction, and the landing position reading unit may read the position of lines or dots which are drawn using the selected nozzle, by correlating the position with the nozzle which draws the lines or dots.

When lines or dots are drawn at the same time by using a plurality of nozzles, if the lines or dots are drawn at the same time by using a plurality of neighboring nozzles, there is a concern that lines or dots which are drawn may be too crowded, and it may be not possible to appropriately read positions of respective lines or dots. In contrast to this, when being configured in this manner, the ink jet head draws a plurality of lines or dots which are aligned with an interval by using the selected nozzle at the time of determining a landing position. For this reason, with such a configuration, it is possible to further appropriately read positions of lines or dots which are drawn by using each nozzle, for example. In addition, in this manner, it is possible to further appropriately detect a deviation in landing position.

In addition, in the configuration, the printing apparatus draws lines or dots using the entire nozzle, by causing positions at which the lines or dots are drawn to be deviated by sequentially changing the selected nozzle, for example. In addition, by reading the position of the lines or dots which are drawn using each of the nozzles, a landing position is checked with respect to each of the nozzles. For this reason, with such a configuration, it is possible to appropriately check the landing position with respect to the entire nozzle in the ink jet head, for example.

In addition, as a method of selecting the selected nozzles, for example, it is possible to take a method into consideration, in which odd-numbered nozzles (or even-numbered nozzles) in the nozzle column direction are firstly selected, lines or dots are drawn by using the selected nozzle, subsequently, even-numbered nozzles (or odd-numbered nozzles) are selected thereafter, and the lines or dots are drawn by using the selected nozzle. In addition, a method in which nozzles of every N+1th nozzle (N is integer of one or greater) in the nozzle column are sequentially selected, and lines or dots sequentially drawn by using the selected nozzle can also be taken into consideration.

Eighth Configuration

In the aspect, the landing position reading unit may be a sensor which moves in the main scanning direction along with the ink jet head in the main scanning operation. With such a configuration, it is possible to appropriately read a landing position of ink droplets while performing the main scanning operation.

Ninth Configuration

In the aspect, the ink jet head may perform a main scanning operation which ejects ink droplets while moving in the main scanning direction which is set in advance, and the landing position reading unit may be a one-dimensional image sensor which images a linear region which extends in the sub-scanning direction which is orthogonal to the main scanning direction. With such a configuration, for example, it is possible to appropriately read a landing position of ink droplets. In addition, in this manner, when a deviation in landing position occurs, for example, it is possible to simply and appropriately detect the deviation.

Tenth Configuration

In the aspect, the landing position reading unit may be a two-dimensional image sensor which images a planar region on a medium. With such a configuration, for example, it is possible to appropriately read a landing position of ink droplets. In addition, in this manner, when a deviation in landing position occurs, for example, it is possible to simply and appropriately detect the deviation.

Eleventh Configuration

In the aspect, a maintenance unit which performs maintenance of the ink jet head may be further included, and the maintenance unit may perform maintenance of the ink jet head when the landing state determination unit determines that the landing position is deviated from the normal position which is set in advance.

The maintenance unit performs wiping as maintenance of the ink jet head, in which a nozzle face is wiped which is a face on which nozzles are formed in the ink jet head, for example. With such a configuration, it is possible to appropriately eliminate a foreign substance, or the like, when the foreign substance or solidified ink is attached to the vicinity of nozzles, and a deviation in landing position occurs, for example. In addition, in this manner, it is possible to appropriately recover the nozzle in which the deviation in landing position occurs so as to be in the normal state. In addition, the maintenance unit may perform suctioning of nozzle, or the like, for example, as the maintenance of the ink jet head.

Twelfth Configuration

According to another aspect of the present invention, there is provided a landing position determination method which determines whether or not a landing position toward a medium on which ink droplets land is deviated from a normal position which is set in advance, in a printing apparatus which performs printing by using an ink jet method. The landing position determination method includes: ejecting ink droplets toward the medium from nozzles of an ink jet head; reading the landing position of ink droplets by using a landing position reading unit; and determining whether or not the landing position is deviated from the normal position, based on the landing position which is read by using the landing position reading unit. With such a configuration, for example, it is possible to obtain the same effect as that in the First Configuration.

According to the present invention, when a deviation in landing position of ink droplets occurs, for example, it is possible to simply and appropriately detect the deviation.

BRIEF DESCRIPTION OF THE DRAWINGS

FIG. 1A illustrates an example of a configuration of main parts of the printing apparatus. FIG. 1B illustrates an example of a further detailed configuration of an ink jet head and a landing position reading unit in the printing apparatus.

FIG. 2A illustrates an example of a state of reading dotted lines which are drawn by using the ink jet head, and are read by using the landing position reading unit. FIG. 2B illustrates an example of a reading result by using the landing position reading unit.

FIG. 3A illustrates an example of a state in which straight lines, which are drawn by using the ink jet head, are read by using the landing position reading unit. FIG. 3B illustrates an example of a reading result by using the landing position reading unit.

FIG. 5A illustrates examples of the straight lines and a reference line which are drawn at a time of determining a landing position. FIG. 5B illustrates an example of a reading result by using the landing position reading unit.

FIG. 6A illustrates an example of the straight lines and the reference line which are drawn at the time of determining a landing position. FIG. 6B illustrates an example of a reading result by using the landing position reading unit.

FIG. 7A illustrates an example of the straight lines and the reference line which are drawn at a time of determining a landing position. FIG. 7B illustrates an example of a reading result by using the landing position reading unit.

DETAILED DESCRIPTION OF THE INVENTION

Figure 1A:
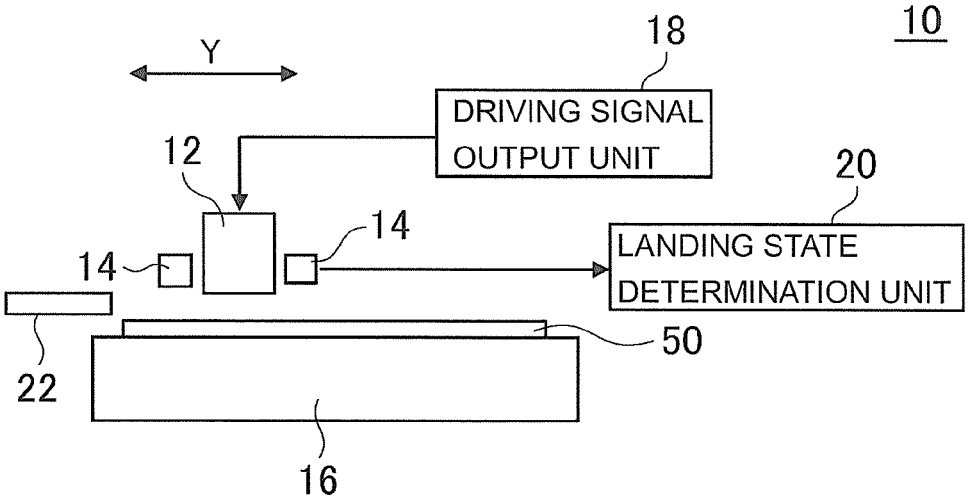
FIGS. 1A and 1B are diagrams which illustrate an example of a configuration of a printing apparatus according to one embodiment of the present invention.
Figure 1B:
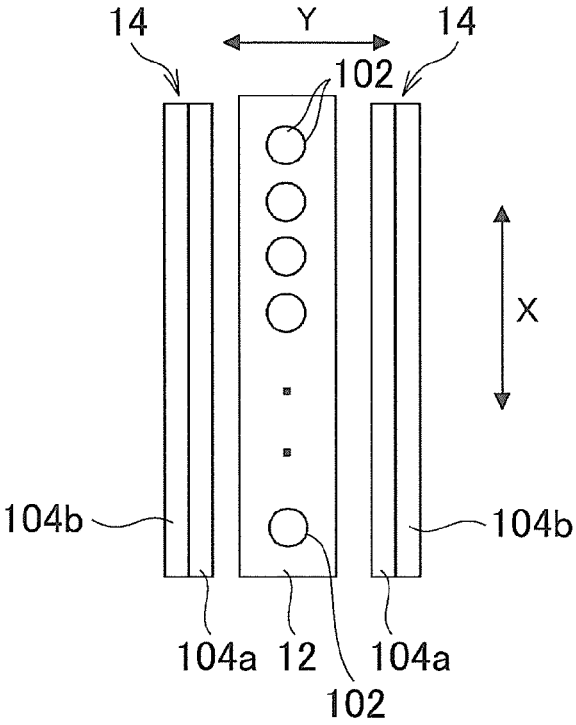

Hereinafter, embodiments according to the present invention will be described with reference to drawings. FIGS. 1A and 1B are diagrams which illustrate an example of a configuration of a printing apparatus 10 according to one embodiment of the present invention. FIG. 1A illustrates an example of a configuration of main parts of the printing apparatus 10. In the embodiment, the printing apparatus 10 is an ink jet printer which performs printing by using an ink jet method with respect to a medium (media) 50, and includes an ink jet head 12, a landing position reading unit 14, a table 16, a driving signal output unit 18, a wiping unit 22, and a landing state determination unit 20. In addition, the printing apparatus 10 may have a configuration the same as or similar to that in a well-known ink jet printer except for points which will be described below. For example, the printing apparatus 10 may have the configuration the same as or similar to that in the well-known ink jet printer, as various configurations which are necessary for printing.

The ink jet head 12 is a print head which ejects ink droplets toward the medium 50. According to the embodiment, the ink jet head 12 has a plurality of nozzles which align in a predetermined nozzle column direction, and ejects ink droplets from respective nozzles according to a driving signal which is received from the driving signal output unit 18 corresponding to each of the nozzles. The driving signal is, for example, a signal which controls an element which causes ink droplets to be ejected in the nozzles of the ink jet head 12. The element is a piezoelectric element or a heating element which is provided corresponding to each of the nozzles, for example, and ejects ink droplets from the nozzles according to a voltage fluctuation in the driving signal. In addition, according to the embodiment, the ink jet head 12 ejects ink droplets on the medium 50 from the nozzles by performing a main scanning operation which ejects ink droplets according to a driving signal, while moving toward the main scanning direction (Y direction in figure) which is set in advance.

In addition, according to the embodiment, when the landing state determination unit 20 is caused to make a determination on a landing position (hereinafter, referred to as "time of determining landing position"), the ink jet head 12 draws a line or dots on the medium 50 by ejecting ink droplets from nozzles, by performing the main scanning operation. In this case, the line is, for example, a column on which ink dots are continuously aligned at positions of a plurality of pixels which are continuous in the main scanning direction. The positions of pixels are, for example, positions of pixels which are aligned at a pitch determined according to resolution of printing. The dot is an ink dot which is formed when ink droplets are landed on a medium.

When a line is drawn on the medium 50, the ink jet head 12 may draw a solid straight line of a solid line, for example, by using a nozzle which draws the line, in the main scanning operation. In this case, the straight line of the solid line is a straight line configured by using a long line which is continuously extended, for example. The straight line of the solid line may be a straight line which forms ink dots at positions of all pixels between a start point and an end point, for example. The ink jet head 12 may draw, for example, a broken straight line, or the like, by using a nozzle which is set to draw a line. In this case, the straight broken line is a straight line which is configured by using a plurality of short lines which align in the main scanning direction by interposing a region in which ink dots are not formed therebetween. The broken line may be, for example, a straight line on which a short constant interval and a short solid straight line with a predetermined length are aligned. In addition, when dots are drawn on the medium 50, the ink jet head 12 may draw a dotted line on which a plurality of dots align in the main scanning direction, by using a nozzle which is set to draw dots. In this case, respective dots which configure the dotted line align in the main scanning direction with a gap of at least one or more pixels therebetween.

In addition, regarding the line or dot which is drawn by using the main scanning operation, the dot is, for example, an isolated dot which is not formed at a position of neighboring pixels. When drawing a dot on a medium, the ink jet head may draw a dotted line on which a plurality of dots align in the main scanning direction by using a nozzle which is set to draw a dot. In this case, each of the dots which configure the dotted line aligns in the main scanning direction with a gap of at least one or more pixels therebetween.

The landing position reading unit 14 is a sensor which reads a landing position which is a position on the medium 50 on which ink droplets are landed. At a time of determining a landing position, the landing position reading unit 14 reads a position of lines or dots which are drawn on the medium 50 by using the nozzle of the ink jet head 12, by correlating the position with the nozzle which draws the lines or dots as a landing position of ink droplets. As the landing position reading unit 14, for example, it is preferable to use a sensor which moves in the main scanning direction along with the ink jet head in the main scanning operation. As such a sensor, for example, it is possible to preferably use a one-dimensional image sensor. The one-dimensional image sensor is, for example, a sensor which images a linear region which extends in the sub-scanning direction (linear image sensor). With such a configuration, when a deviation in landing position occurs due to flying astray of ink droplets, or the like, for example, it is possible to simply and appropriately detect the deviation. The one-dimensional image sensor may be a line sensor which reads a region with a width of approximately 1 inch to 2 inches, for example. In addition, the landing position reading unit 14 may have a configuration in which a plurality of one-dimensional image sensors is aligned, for example. In addition, in a modification example of the configuration of the printing apparatus 10, a configuration in which, for example, a two-dimensional image sensor which images a planar region on the medium 50 is used as the landing position reading unit 14 can also be taken into consideration.

In addition, according to the embodiment, the landing position reading unit 14 further includes a function of a line width measuring unit, and when a line is drawn by using the ink jet head 12 at the time of determining a landing position, a line width of the line which is drawn on the medium 50 is measured. Operations of the landing position reading unit 14 will be described in detail later.

The table 16 is a holding member which holds the medium 50, and holds the medium 50 by causing the medium to face the ink jet head 12. The driving signal output unit 18 is a signal output unit which outputs a driving signal to the ink jet head 12, and supplies a driving signal with respect to each of the plurality of nozzles in the ink jet head 12. The wiping unit 22 has a configuration for performing wiping of a nozzle face which is a face on which the nozzles are formed in the ink jet head 12. According to the embodiment, the wiping unit 22 is an example of the maintenance unit, and for example, performs wiping when performing maintenance of the ink jet head 12, or the like, as necessary. In addition, as the maintenance of the ink jet head 12, for example, performing suctioning of nozzles, or the like, is also taken into consideration.

The landing state determination unit 20 is a determination unit which determines a landing position which is read by using the landing position reading unit 14. According to the embodiment, the landing state determination unit 20 determines whether or not a landing position is deviated from a normal position with respect to a nozzle which draws lines or dots based on a position of the lines or dots which is read by using the landing position reading unit 14. Regarding the landing position of ink droplets, when the landing position is deviated from the normal position, it means that the position is deviated from a position in a predetermined range about a standard landing position which is determined in design, for example. In addition, according to the embodiment, when a line width of a line which is drawn on the medium 50 is measured by the landing position reading unit 14, the landing state determination unit 20 further determines whether or not the measured line width is in the reference range which is set in advance. Operations of the landing state determination unit 20 will also be described in detail later.

In addition, as described above, according to the embodiment, the printing apparatus 10 further includes a configuration the same as or similar to a well-known ink jet printer, for example, in addition to the above described main parts. For example, the printing apparatus 10 further includes a driving unit, or the like, which causes the ink jet head 12 to perform a main scanning operation or a sub-scanning operation. The sub-scanning operation is an operation which moves the ink jet head 12 relative to the medium 50 toward the sub-scanning direction (X direction) which is orthogonal to the main scanning direction (Y direction). The printing apparatus 10 performs an operation of sending the medium 50 to the ink jet head 12 by performing the sub-scanning operation between the main scanning operations. In addition, due to these operations, the printing apparatus 10 performs printing with respect to each position on the medium 50.

In addition, the printing apparatus 10 may include a plurality of the ink jet heads 12, for example. For example, when the printing apparatus 10 has a configuration of performing color printing, the printing apparatus 10 may include the plurality of ink jet heads 12 which eject ink of each color of yellow, magenta, cyan, and black. In this case, the driving signal output unit 18 supplies a driving signal to the nozzles of each of the ink jet heads 12.

Subsequently, further detailed configuration of the ink jet head 12 and the landing position reading unit 14 according to the embodiment will be described. FIG. 1B illustrates an example of a further detailed configuration of the ink jet head 12 and the landing position reading unit 14 in the printing apparatus 10. According to the embodiment, the plurality of nozzles 102 of the ink jet head 12 align by having the X direction as a nozzle column direction.

In addition, the landing position reading units 14 are respectively provided on both sides of the ink jet head 12 in the Y direction. Each of the landing position reading units 14 is configured so as to move along with the ink jet head 12, for example, and when the ink jet head 12 moves in the Y direction due to a main scanning operation, for example, the landing position reading unit moves in the Y direction along with the ink jet head 12.

In addition, according to the embodiment, the ink jet head 12 ejects ink droplets on the medium 50 in both directions of a forward path and a return path in the main scanning operation, for example. For this reason, in the landing position reading units 14 which are respectively provided on both sides of the ink jet head 12, one side is arranged on the front side in the moving direction, and the other side is arranged on the rear side in the moving direction according to the moving direction of the ink jet head 12 at the time of the main scanning operation. For this reason, with such a configuration, it is possible to perform reading of a landing position, or the like, during the main scanning operation in which lines or dots are drawn by using the ink jet head 12, using the landing position reading unit 14 which is arranged on the rear side of the ink jet head 12 in the moving direction of the ink jet head 12, at the time of determining a landing position, for example. In addition, in this manner, it is possible to efficiently and appropriately perform reading of a landing position, or the like, for example.

In addition, according to the embodiment, each of the landing position reading units 14 includes a plurality of sensor units 104*a* and 104*b*. Among the sensor units, the sensor unit 104*a* is a sensor which reads a landing position of ink droplets which is ejected from odd-numbered nozzles 102 in the nozzle column (for example, one-dimensional image sensor). In addition, the sensor unit 104*b* is a sensor which reads a landing position of ink droplets which is ejected from even-numbered nozzles 102 in the nozzle column (for example, one-dimensional image sensor). For the sensor units 104*a* and 104*b*, for example, a configuration in which a photo-sensor and a light source are combined can be preferably used. As the light source, for example, it is preferable to use an LED, a laser diode (LD), or the like.

With the above described configuration, according to the embodiment, when a deviation in landing position occurs, for example, it is possible to simply and appropriately detect the deviation. In addition, in this manner, it is possible to appropriately prevent a printing quality from being influenced by an uneven ejecting property of the nozzle, or the like. In addition, for example, it is possible to perform maintenance such as wiping by using the wiping unit 22, as necessary. In addition, in this manner, it is possible to recover the nozzle so as to be in a normal state by eliminating a foreign substance, or the like, which is attached to the position of the nozzle, when the foreign substance, solidified ink, or the like is attached to the vicinity of the nozzle, and a deviation in landing position occurs, for example.

In addition, more specifically, according to the embodiment, when the read landing position is deviated from the normal position, the landing state determination unit 20 causes the wiping unit 22 to perform wiping. In this manner, when a deviation in landing position is detected, it is possible to automatically perform maintenance of the ink jet head 12. In addition, when the read landing position is deviated from the normal position, the landing state determination unit 20 may receive an instruction of a user by performing a display of errors or warnings. With such a configuration, for example, it is possible to perform maintenance, or the like, according to a received instruction without performing maintenance automatically. In addition, when the nozzle is not recovered after maintenance of a predetermined number of times, for example, the display of errors, warnings, or the like may be performed.

In addition, for example, when it is possible to recover the nozzle so as to be in the normal state due to a correction of a driving signal, performing the correction of the driving signal is also taken into consideration. For example, when it is determined by the landing state determination unit 20 that a line width which is measured by using the landing position reading unit 14 is not in the reference range which is set in advance, adjusting of a size of ink droplets, or the like is taken into consideration by correcting a driving signal which is supplied to the nozzle which draws the line. In this case, it is preferable that the printing apparatus 10 further include a signal correction unit which corrects a driving signal which is supplied to each nozzle. In addition, for example, a function of the signal correction unit may be further provided to the driving signal output unit 18, the landing state determination unit 20, or the like.

Subsequently, operations of the landing position reading unit 14 and the landing state determination unit 20 will be described in detail. First, an example of operations in which lines or dots which are read by using the landing position reading unit 14, and are drawn by the ink jet head 12 will be described.

As in the embodiment, when lines or dots are drawn at the same time by using the plurality of nozzles 102 of the ink jet head 12, if the lines or dots are drawn at the same time by using the plurality of nozzles 102 which are neighboring, there is a concern that drawn lines or dots may be too crowded, and it may not be possible to appropriately read positions of each of the lines or dots. For this reason, at the time of determining a landing position in the embodiment, the ink jet head 12 draws lines or dots on a medium by using a selected nozzle which is a part of nozzles selected from the plurality of nozzles 102. In addition, in this case, the selected nozzles are selected so as to interpose at least one or more non-selected nozzle therebetween in the nozzle column direction. In addition, the landing position reading unit 14 reads the position of the lines or dots which are drawn by using the selected nozzle, and by correlating the position with the nozzle which draws the lines or dots.

In this manner, at the time of determining a landing position in the embodiment, the ink jet head 12 draws a plurality of lines or dots which align with a gap therebetween, by using the selected nozzle. For this reason, according to the embodiment, it is possible to further appropriately read the positions of lines or dots which are drawn by using each nozzle 102, for example. In addition, in this manner, it is possible to further appropriately detect a deviation in landing position.

In addition, in this case, at the time of determining a landing position, the ink jet head 12 draws lines or dots using all of nozzles 102 by causing positions of drawing lines or dots to be deviated, by sequentially changing a selected nozzle, for example. In addition, the landing position reading unit 14 reads positions of lines or dots which are drawn by using each of the nozzles 102. In addition, the landing state determination unit 20 makes a determination on a landing position with respect to each of the nozzles 102 based on a reading result of the landing position reading unit 14. With such a configuration, for example, it is possible to appropriately check a landing position with respect to all of the nozzles 102 in the ink jet head 12.

In addition, more specifically, as a method of selecting a nozzle to be selected, for example, a method in which odd-numbered (or even-numbered) nozzles in the nozzle column direction are firstly selected, lines or dots are drawn by using the selected nozzle thereafter, subsequently, even-numbered (or odd-numbered) nozzles are selected, and then lines or dots are drawn by using the selected nozzle, or the like, is taken into consideration. In addition, a method in which nozzles of every N+1th nozzle (N is integer of one or more) of the nozzle column are sequentially selected, and lines or dots are drawn by using the selected nozzle is also taken into consideration.

Subsequently, operations of reading a landing position of the drawn lines or dots, or the like will be described. In addition, operations which will be described below are operations which are performed at the time of determining a landing position, for example. In addition, the operations may be operations which are performed when receiving an instruction of a user in the interval of a normal printing operation, or the like, for example.

Figure 2A:
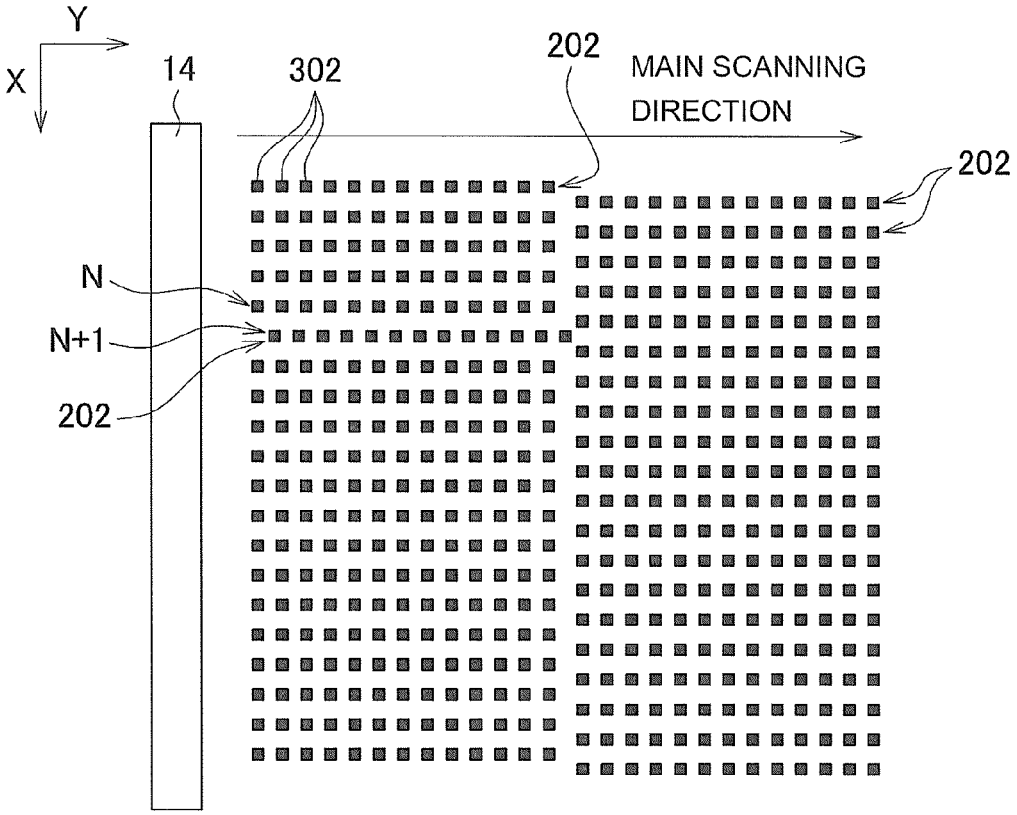
FIGS. 2A and 2B are diagrams which describe operations of the landing position reading unit and a landing state determination unit in the embodiment.
Figure 2B:
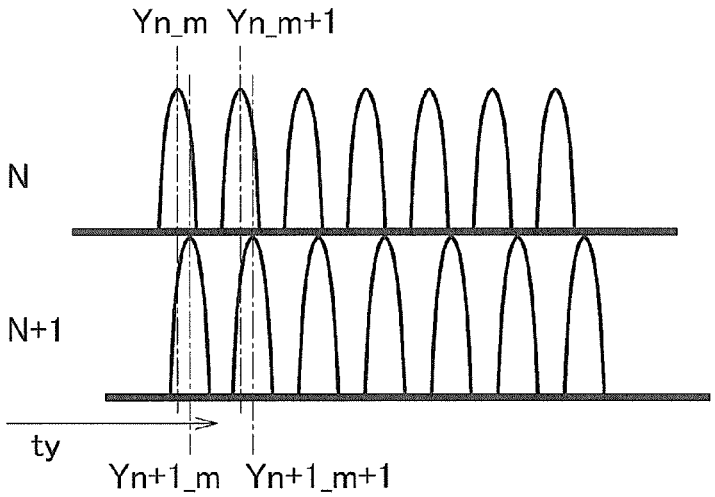

FIGS. 2A and 2B are diagrams which describe operations of the landing position reading unit 14 and the landing state determination unit 20 in the embodiment, and illustrate an example of operations when a deviation in landing position in the main scanning direction is detected. FIG. 2A illustrates an example of a state of reading dotted lines 202 which are drawn by using the ink jet head 12, and by using the landing position reading unit 14. FIG. 2B illustrates an example of a reading result by using the landing position reading unit 14. In addition, in FIG. 2A, for ease of illustration, among the configurations of the printing apparatus 10, only the landing position reading unit 14 (linear image sensor, or the like) is illustrated.

According to the embodiment, when a deviation in landing position in the main scanning direction is detected at the time of determining a landing position, the ink jet head 12 draws the dotted line 202 on the medium 50 by using each of the plurality of nozzles which align in the sub-scanning direction. The dotted line 202 is an example of a line or a dot which is drawn on the medium 50. In addition, the ink jet head 12 draws the dotted line 202 on the medium 50 by drawing a plurality of dots 302 which align in the main scanning direction with a gap therebetween, by using each nozzle. In addition, in this manner, the ink jet head 12 draws a plurality of the dotted lines 202 which align in the sub-scanning direction on the medium 50.

In addition, first, the ink jet head 12 draws the dotted line 202 by using a selected nozzle by setting an odd numbered nozzle in the nozzle column as the selected nozzle during a main scanning operation of one time. In addition, the ink jet head draws the dotted line 202 using a selected nozzle by setting an even numbered nozzle in the nozzle column as the selected nozzle, after completing the drawing of the dotted line 202 using the odd-numbered nozzle. In this manner, the printing apparatus 10 draws the dotted line 202 on the medium 50 using all of the nozzles in the ink jet head 12.

In addition, when the printing apparatus 10 includes the plurality of ink jet heads 12, for example, drawing of the dotted line 202 using each nozzle 102 of each of the ink jet heads 12 may also be performed during a main scanning operation of one time, for example. In addition, the dotted line 202 may be drawn using the respective nozzle 102 of each of the ink jet heads 12 by performing a separate main scanning operation in each ink jet head 12.

In addition, the landing position reading unit 14 reads positions in the main scanning direction of each of the dotted lines 202 by correlating the positions with nozzles which draw each of the dotted lines 202 by performing a reading operation while moving in the main scanning direction with a certain velocity along with the ink jet head 12 which draws the dotted line 202. For example, as illustrated in FIG. 2B, the reading can be performed by detecting a position in a region with a certain density or more on the medium 50 as peak values happened accompanying with time passage. And, as illustrated in FIG. 2B, "ty" direction indicates a direction of the time passage. In this case, the landing position reading unit 14 detects a position of the dotted line 202 in the main scanning direction by detecting a position of the dot 302 which is included on the dotted line 202, for example. Detecting the position of the dot 302 may be only performed with respect to a part of dots 302 on the dotted line 202, for example. In addition, reading of a position of the dotted line 202 using the landing position reading unit 14 may be performed using various methods which are well known, for example, in addition to the above described method.

In addition, the landing state determination unit 20 determines whether or not a landing position in the main scanning direction is deviated from the normal position with respect to the nozzle which draws the dotted line 202 based on the position of the dotted line 202 which is read using the landing position reading unit 14. More specifically, according to the embodiment, the landing state determination unit 20 compares respective positions of the plurality of dotted lines 202 with the others, based on the positions of the plurality of dotted lines 202 in the main scanning direction which are read using the landing position reading unit 14. In this case, comparing of positions of the dotted lines 202 means comparing of positions of the dots 302 on each of the dotted lines 202, for example. In addition, when a relative position of the dotted line 202 with respect to other dotted lines 202 is deviated from a predetermined range based on the comparison result, it is determined that a landing position in the main scanning direction is deviated from the normal position with respect to the dotted line 202. In addition, in this manner, the landing state determination unit 20 determines whether or not the landing position in the main scanning direction is deviated from the normal position with respect to each of the nozzles which draws the respective dotted lines 202. For this reason, according to the embodiment, it is possible to appropriately detect the deviation in landing position in the main scanning direction with respect to each of the nozzles in the ink jet head, for example.

More specifically, for example, a reading result using the landing position reading unit 14 with respect to the dotted lines 202 which are illustrated as Nth and N+1th dotted lines in FIG. 2A becomes as illustrated in FIG. 2B. In addition, in this case, when a position of the mth dot 302 in the Nth dotted line 202 is set to Yn_m, a position of the m+1th dot 302 is set to Yn_m+1, a position of the mth dot 302 in the N+1th dotted line 202 is set to Yn+1_m, and a position of the m+1th dot 302 is set to Yn+1_m+1, or the like, it is possible to appropriately determine whether or not a landing position in the main scanning direction is deviated with respect to other dotted lines 202, regarding each of the dotted lines 202, by calculating a difference between Yn+1_m and Yn_m, or a difference between Yn+1_m+1 and Yn_m+1, for example. For example, in the case which is illustrated in FIG. 2B, it is possible to appropriately determine that a landing position in the N+1th dotted line 202 is deviated in the main scanning direction compared to a landing position in the Nth dotted line 202, or the like.

In addition, for example, it is possible to appropriately determine whether or not a position in the main scanning direction is deviated from the normal position with respect to each of the dotted lines 202, by comparing neighboring dotted lines 202 in both the upper direction and the lower direction in FIG. 2A, or by further comparing a position in the main scanning direction between one dotted line 202 and the other dotted line 202, not with respect to only one neighboring dotted line 202.

For this reason, according to the embodiment, when a deviation in landing position in the main scanning direction occurs in any of nozzles with respect to a respective plurality of nozzles which align in the sub-scanning direction, for example, it is possible to simply and appropriately detect the deviation. In addition, in this manner, it is possible to appropriately perform maintenance of the ink jet head, or the like, as necessary. In addition, for example, when it is possible to recover the nozzle so as to be in the normal state using a correction of a driving signal, performing a correction of the driving signal can be taken into consideration.

Figure 3A:
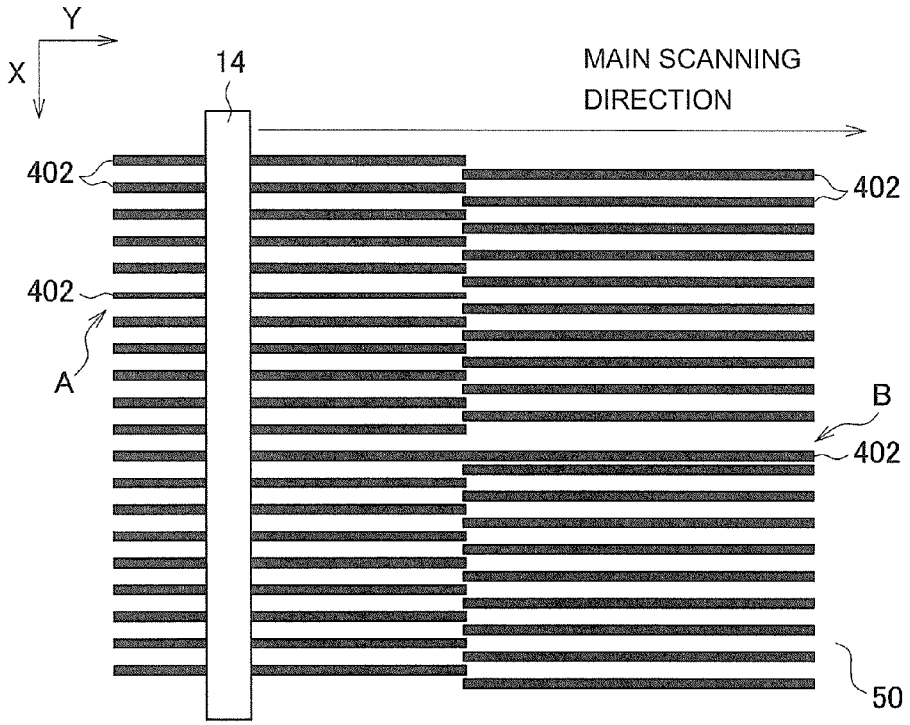
FIGS. 3A and 3B are diagrams which describe other operations of the landing position reading unit and the landing state determination unit in the embodiment.
Figure 3B:
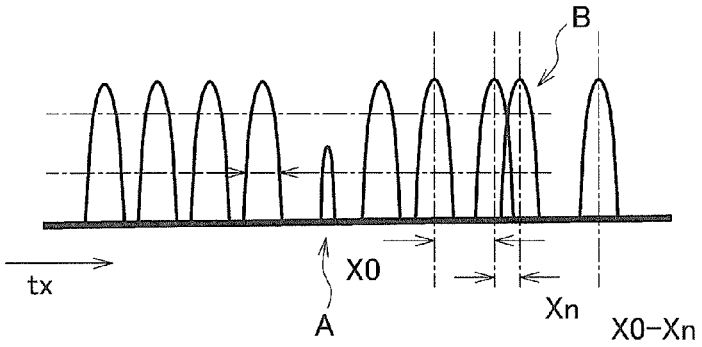

FIGS. 3A and 3B are diagrams which describe other operations of the landing position reading unit 14 and the landing state determination unit 20 in the embodiment, and illustrate an example of operations when detecting a deviation in landing position in the sub-scanning direction. FIG. 3A illustrates an example of a state in which a straight line 402 which is drawn using the ink jet head 12 is read using the landing position reading unit 14. FIG. 3B illustrates an example of a reading result using the landing position reading unit 14. In addition, in FIG. 3A, for ease of illustration, only the landing position reading unit 14 (linear image sensor, or the like) among the configurations of the printing apparatus 10 is illustrated.

According to the embodiment, when a deviation in landing position in the sub-scanning direction is detected at the time of determining a landing position, the ink jet head 12 draws the solid straight line 402 which extends in the main scanning direction on the medium 50 by ejecting ink droplets from each of the plurality of nozzles which align in the sub-scanning direction. In addition, in this manner, the ink jet head 12 draws the plurality of straight lines 402 which align in the sub-scanning direction on the medium 50.

In addition, in this case, the straight line 402 is an example of a line or dot which is drawn on the medium 50. In addition, similarly to the operation of drawing the dotted line 202 which is described using FIGS. 2A and 2B, also in the operation which is described using FIGS. 3A and 3B, the plurality of straight lines 402 are drawn using odd-numbered selected nozzles in a main scanning operation of one time, and the plurality of straight lines 402 are drawn using even-numbered selected nozzles thereafter. In addition, in this manner, the printing apparatus 10 draws the straight line 402 on the medium 50 using all of the nozzles in the ink jet head 12.

In addition, when the printing apparatus 10 includes the plurality of ink jet heads 12, for example, drawing of the straight line 402 using each nozzle 102 of each ink jet head 12 may also be performed during a main scanning operation of one time, for example. In addition, drawing of the straight line 402 using each nozzle 102 of each ink jet head 12 may also be performed by performing a separate main scanning operation in each ink jet head 12.

In addition, the landing position reading unit 14 reads a position in the sub-scanning direction of each of the straight lines 402 by correlating the position with the nozzles which draw the respective straight lines 402 as a landing position of ink droplets in the sub-scanning direction, by performing a reading operation while moving with a certain velocity in the main scanning direction along with the ink jet head 12 which draws the straight line 402. In addition, according to the embodiment, the landing position reading unit 14 further performs measuring of the line width of each of the straight lines 402, in addition to detecting of the position of the straight line 402 in the sub-scanning direction.

In addition, more specifically, the reading of the position of the straight line 402 can be performed by reading a position of a region with a certain density or more on the medium 50 as peak values happened accompanying with time passage, for example, as illustrated in FIG. 3B. And, as illustrated in FIG. 3B, "tx" direction indicates a direction of the time passage. In this case, for example, reading a position with a peak density as a position of the straight line 402 with respect to a region with a certain density or more on the medium 50 can be taken into consideration. In addition, measuring of the line width can be performed by detecting a width of a region with a certain density or more on the medium 50, for example, as illustrated in FIG. 3B. In addition, reading of a position of the straight line 402 using the landing position reading unit 14, or measuring of the line width may be performed using well-known various methods, for example, in addition to the above described method.

In addition, the landing state determination unit 20 determines whether or not a landing position in the sub-scanning direction is deviated from the normal position with respect to a nozzle which draws a straight line 402 based on a position of the straight line 402 which is read using the landing position reading unit 14. In the determination, the landing state determination unit 20 calculates an interval (pitch) of the straight line 402 in the sub-scanning direction between the straight line and a neighboring straight line 402, with respect to each of the plurality of straight lines 402 which align in the sub-scanning direction based on a position of the straight line 402 which is read using the landing position reading unit 14, for example. In addition, the landing state determination unit determines whether or not the landing position in the sub-scanning direction is deviated from the normal position with respect to the nozzle which draws each of the straight lines 402 based on a calculated interval.

In addition, more specifically, in the determination, the landing state determination unit 20 measures a distance Xn between the nth straight line 402 and a neighboring straight line 402 with respect to the nth straight line 402 (n is integer of 1 or greater), for example. In addition, the landing state determination unit calculates an absolute value of a difference (X0-Xn) between a standard distance X0 which is set in advance and the distance Xn based on the measured distance Xn. In addition, when the absolute value becomes greater than a predetermined threshold value, it is determined that a landing position in the sub-scanning direction is deviated from the normal position with respect to the nozzle which draws the straight line 402.

For example, when a deviation in landing position in the sub-scanning direction occurs in any of nozzles, a position of a drawn straight line 402 is deviated in the sub-scanning direction, like the straight line 402 to which a mark B is attached in FIG. 3A. In addition, as a result, an interval (pitch) between the straight line and a neighboring straight line 402 is changed as in a portion to which a mark B is attached in FIG. 3B, and the straight line deviates from the reference range. For this reason, according to the embodiment, it is possible to appropriately detect a deviation in a landing position of ink droplets in the sub-scanning direction with respect to respective nozzles in the ink jet head by reading a position of the straight line 402 in the sub-scanning direction.

In addition, as described above, according to the embodiment, the landing state determination unit 20 also determines whether or not the line width which is measured by the landing position reading unit 14 is in the reference range which is set in advance with respect to each of the straight lines 402.

For example, when a size of ejected ink droplets is not in the reference range in any of nozzles, a line width thereof becomes different from that of a straight line 402 which is drawn using a normal nozzle, like the straight line 402 to which the mark A is attached in FIG. 3A. In addition, as a result, a line width which is different from that of other straight lines is measured like the portion to which the mark A is attached in FIG. 3B. For this reason, it is possible to appropriately check whether or not respective sizes of ink droplets which are ejected from each of the nozzles are in the reference range by measuring a line width.

In this manner, according to the embodiment, when a deviation in landing position in the sub-scanning direction occurs in any of each of the plurality of nozzles which align in the sub-scanning direction, for example, it is possible to simply and appropriately detect the deviation. In addition, also in a case in which abnormality occurs in a size of ink droplets which are ejected from each of the nozzles, it is possible to simply and appropriately detect the abnormality. In addition, in this manner, it is possible to appropriately perform maintenance of the ink jet head, or the like, as necessary. In addition, for example, when it is possible to recover a nozzle so as to be in a normal state using a correction of a driving signal, performing a correction of the driving signal can be also taken into consideration.

In addition, when an occurrence of abnormality in a size of ink droplets is detected, there is a case in which performing a correction of the driving signal is particularly effective. In this case, for example, it is possible to appropriately make a size of ink droplets close to the original size to be ejected by correcting an amount of change due to an uneven ejecting property with respect to a size of ink droplets ejected from a nozzle, or the like, by correcting the driving signal according to the measured line width. With such a configuration, it is possible to suppress abnormality in which a size of ink droplets ejected from each nozzle of the ink jet head varies using a simple and appropriate method.

Subsequently, a modification example of a configuration of the printing apparatus 10 will be described. In the above descriptions, the configuration which is preferable when a one-dimensional image sensor is used as the landing position reading unit 14 has been described with reference to FIGS. 1A to 3B. However, it is also possible to use a two-dimensional image sensor, or the like, for example, as the landing position reading unit 14, other than the one-dimensional image sensor.

FIGS. 4 to 7B are diagrams which describe a configuration and operations of the printing apparatus 10 when the two-dimensional image sensor is used as the landing position reading unit 14. In addition, the configuration and operations of the printing apparatus 10 in a modification example (hereinafter, referred to as the modification example) are the same as or similar to the configuration and operations of the printing apparatus 10 which has been described with reference to FIGS. 1A to 3B except for points which will be described below.

Figure 4:
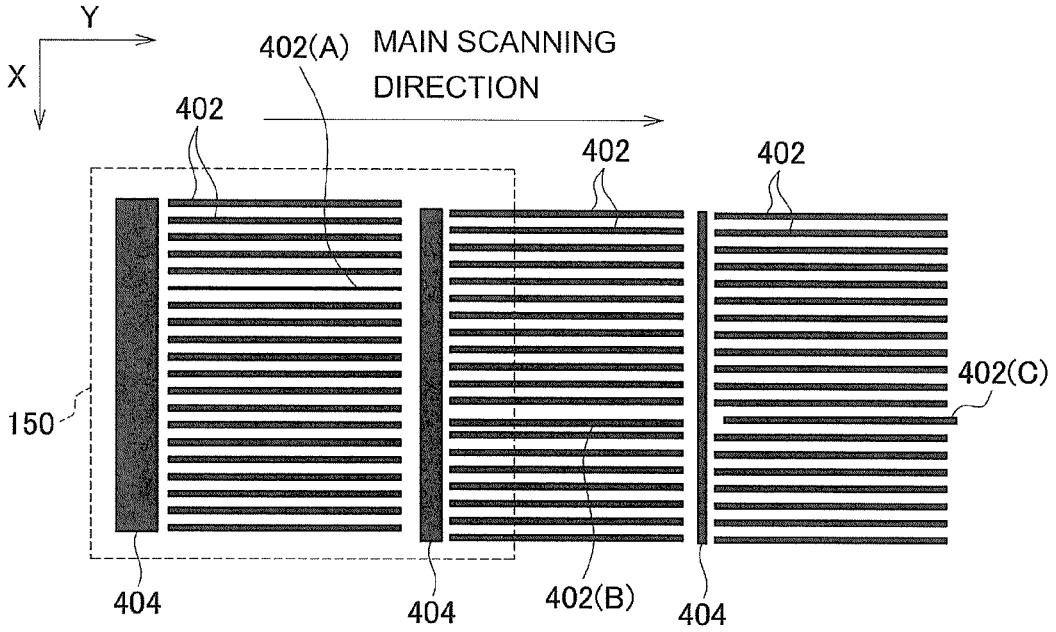
FIG. 4 is a diagram which illustrates an example of operations of the printing apparatus when using a two-dimensional image sensor.

FIG. 4 illustrates an example of operations of the printing apparatus 10 when the two-dimensional image sensor is used. In the modification example, as the two-dimensional image sensor, it is possible to use a well-known imaging element such as a CCD camera, for example. With such a configuration, it is possible to appropriately detect, for example, a deviation in landing position, a line width of a line which is drawn on a medium, or the like, with sufficiently good precision. In addition, the two-dimensional image sensor is arranged at a predetermined fixed position in the printing apparatus 10. In addition, the two-dimensional image sensor may be movably arranged with respect to a medium 50.

In addition, at a time of determining a landing position in the modification example, a straight line 402 and a reference line 404 are drawn using the ink jet head in the printing apparatus 10. The straight line 402 is an example of a line or dot which is drawn on a medium at the time of determining a landing position. In addition, the reference line 404 is a pattern (hereinafter, referred to as reference point calculation pattern) which becomes a reference of a position of the straight line 402. In the modification example, the ink jet head draws the reference line 404 which extends in the sub-scanning direction. In addition, a line width of the reference line 404 becomes different in each timing in a main scanning operation, for example. The timing in the main scanning operation is, for example, timing which denotes which number of main scanning operations in a plurality of main scanning operations it is, timing of changing a selected nozzle during a main scanning operation of one time, or the like.

With such a configuration, for example, it is possible to appropriately discern drawn timing of a straight line 402 which is drawn on a medium in the main scanning operation (for example, the number of times of main scanning operation in which the straight line is drawn, or the like). In addition, as the reference point calculation pattern, a pattern which is different from the reference line 404 may be used. For example, as the reference point calculation pattern, a closing line is also taken into consideration. In addition, for example, a type of straight line which is different from the straight line 402 may be used.

In addition, in the modification example, the landing position reading unit 14 may image a straight line 402 which is drawn on a medium after the ink jet head performs a plurality of main scanning operations, for example. In this case, for example, since it is not necessary to move the landing position reading unit 14 at the time of main scanning operation, it is not necessary to provide a driving unit, or the like, for moving the landing position reading unit 14, for example. In addition, in this manner, it is possible to make the configuration of the printing apparatus 10 simpler.

Here, in FIG. 4, regarding a combination of a plurality of the straight lines 402 and the reference line 404, examples of three combinations in which positions are set to be different are illustrated. In addition, in FIG. 4, a field of vision 150 is an example of a field of vision which can be imaged one time using the landing position reading unit 14. The landing position reading unit 14 images the straight line 402 and the reference line 404 which are drawn at respective positions by performing imaging by deviating positions a plurality of times, for example. In addition, in this manner, reading of positions, measuring of the line width, or the like of each of the straight lines 402 is performed.

In addition, when reading the position of the straight line 402, or measuring the line width, it is possible to perform operations the same as or similar to those which are described with reference to FIGS. 1A to 3B, for example. In this manner, for example, when there is a straight line 402 of which the line width is abnormal (for example, straight line 402 to which mark A is attached in FIG. 4), or a straight line 402 which is not in the normal state (for example, straight lines 402 to which marks B and C are attached), it is possible to appropriately detect the abnormality.

Figure 5A:
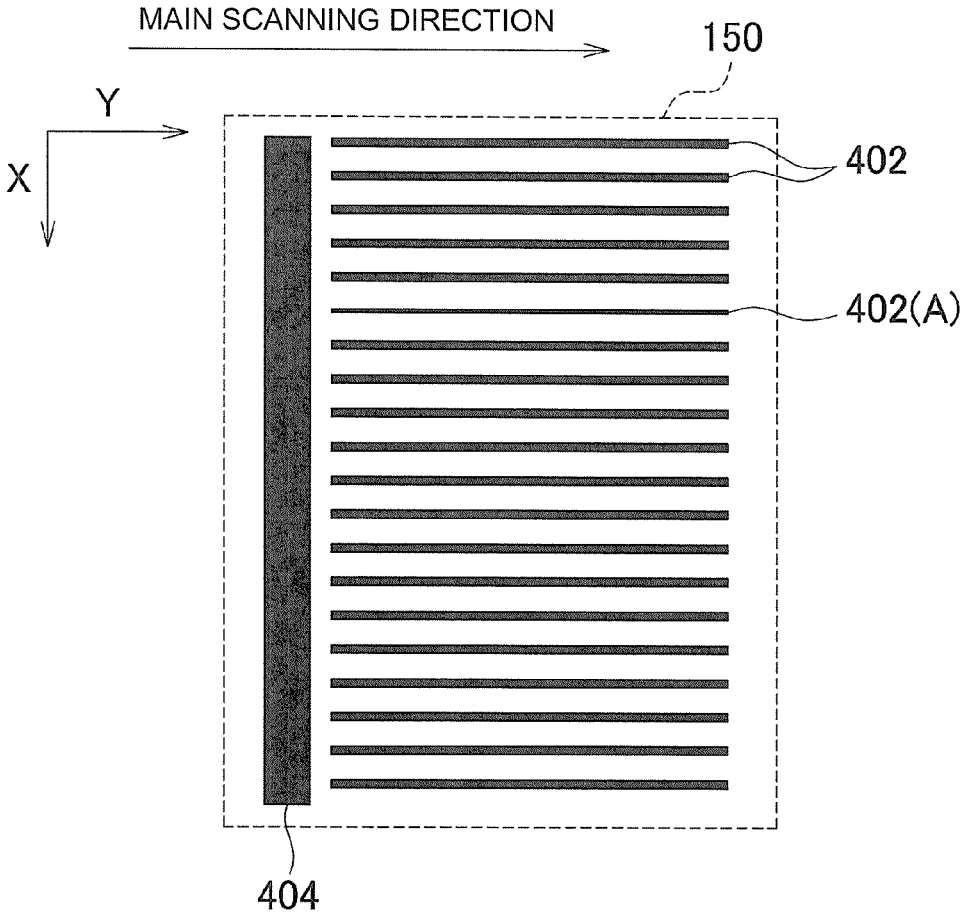
FIGS. 5A and 5B are diagrams which describe an example of operations of measuring a line width of the straight lines.
Figure 5B:
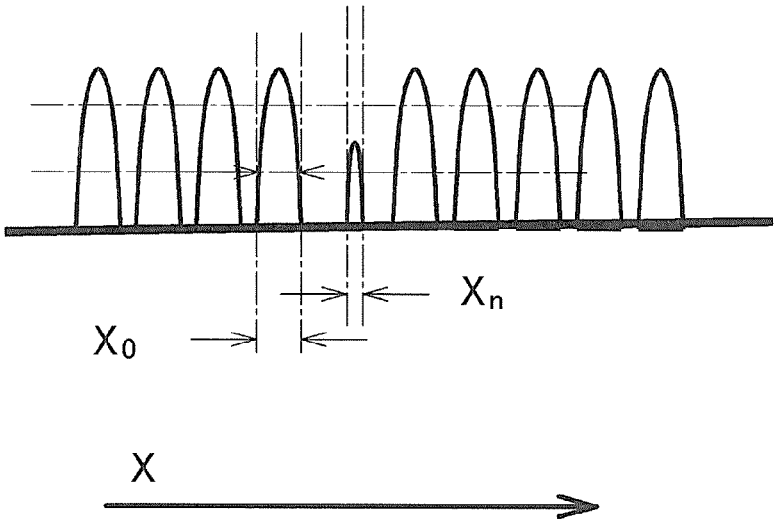

Subsequently, the operation of reading the state of the straight line 402 in the modification example will be described in detail. FIGS. 5A and 5B are diagrams which describe an example of operations of measuring the line width of the straight line 402. FIG. 5A illustrates examples of the straight line 402 and the reference line 404 which are drawn at a time of determining a landing position. FIG. 5B illustrates an example of a reading result using the landing position reading unit 14.

As illustrated in FIG. 5A, in the modification example, when the line width of the straight line 402 is measured, the plurality of straight lines 402 and the reference line 404 are drawn using the ink jet head. In addition, an image in the field of vision 150 including the plurality of straight lines 402 and the reference line 404 is imaged using the landing position reading unit 14 which is the two-dimensional image sensor. In addition, as illustrated in FIG. 5B, measuring, determining, or the like of the line width is performed based on the imaged image. The operation can be performed similarly to that in the printing apparatus 10 which is described with reference to FIGS. 1A to 3B, for example. More specifically, for example, the printing apparatus 10 in the modification example also reads a position of a region with a certain density or more on a medium, and measures the line width by detecting the width of the region with a certain density or more on the medium similarly to the operation which is described using FIG. 3B, or the like. In addition, the landing state determination unit deter lines whether or not each of the straight lines 402 is in the reference range in which the measured line width is set in advance, based on a measurement result of the line width.

For example, when a size of ink droplets becomes small in any of nozzles, the line width of a drawn straight line 402 becomes small like the straight line 402 to which the mark A is attached in FIG. 5A. In addition, as a result, as illustrated in FIG. 5B, the width of the region with a certain density or more on a medium also becomes small. For this reason, with such a configuration, it is possible to appropriately determine a size of ink droplets ejected from the nozzle which draw each of the straight lines 402 based on the measurement result of the line width, for example.

In addition, when a size of ink droplets is out of a defined range, for example, a correction of a driving signal or performing maintenance such as nozzle cleaning (wiping of nozzle face of ink jet head, suctioning, or the like) is taken into consideration. In addition, when a nozzle state is not recovered even when maintenance of a predetermined number of times is performed, performing an error display, warnings, or the like (alarm for prompting exchange of head, or the like) is also taken into consideration.

Figure 6A:
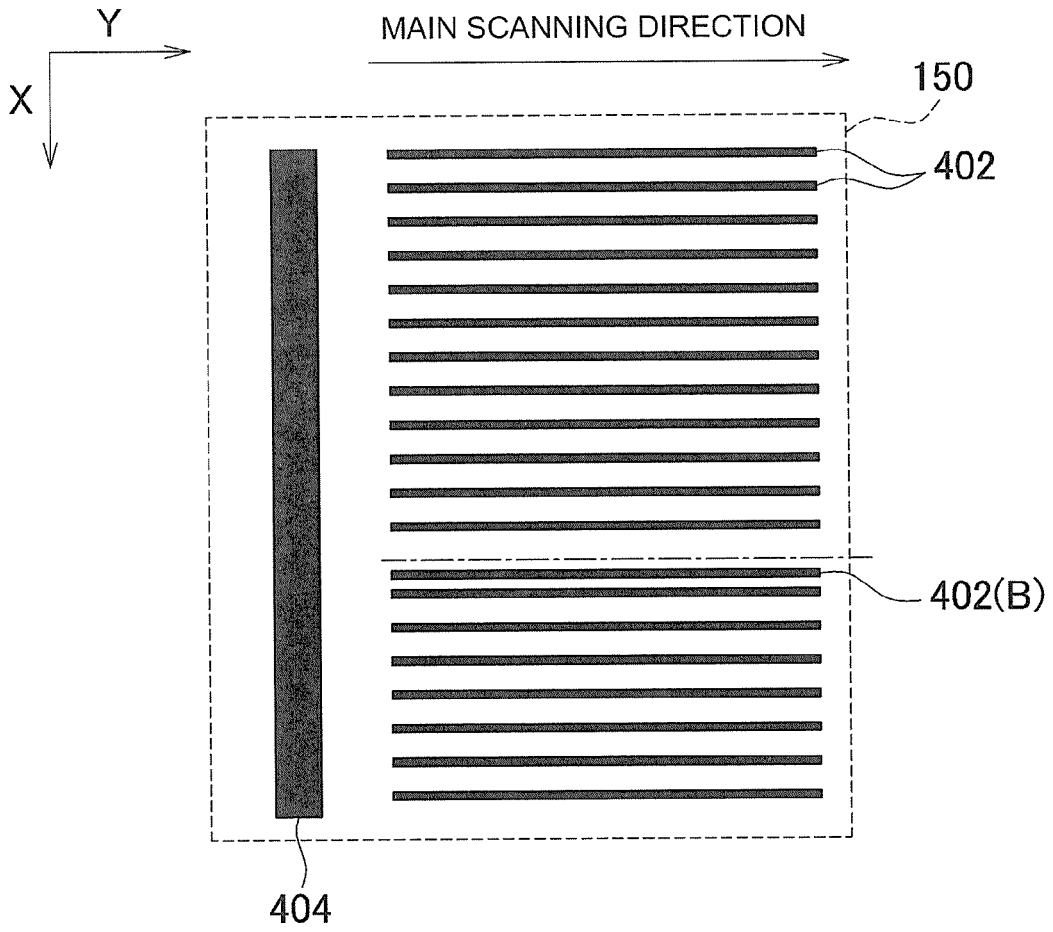
FIGS. 6A and 6B are diagrams which describe an example of operations of determining a landing position of ink droplets in the sub-scanning direction.
Figure 6B:
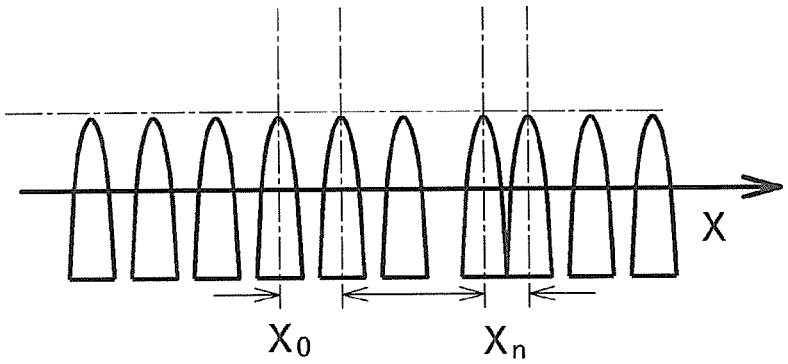

Subsequently, an example of operations which determine a landing position of ink droplets in the sub-scanning direction will be described. FIGS. 6A and 6B are diagram which describe an example of operations of determining a landing position of ink droplets in the sub-scanning direction. FIG. 6A illustrates an example of the straight line 402 and the reference line 404 which are drawn at the time of determining a landing position. FIG. 6B illustrates an example of a reading result using the landing position reading unit 14.

As illustrated in FIG. 6A, in the modification example, even when determining a landing position of ink droplets in the sub-scanning direction, the plurality of straight lines 402 and the reference line 404 are drawn using the ink jet head. In addition, an image in the field of vision 150 including the plurality of straight lines 402 and the reference line 404 is imaged using the landing position reading unit 14 as the two-dimensional image sensor. In addition, as illustrated in FIG. 6B, determination of a landing position of ink droplets in the sub-scanning direction, or the like, is made based on the imaged image. The operation can be performed similarly to that in the printing apparatus 10 which is described with reference to FIGS. 1A to 3B, for example.

More specifically, for example, the printing apparatus 10 according to the modification example also reads a position with a peak density as a position of the straight line 402 with respect to a region with a certain density or more on the medium, similarly to the operation which is described using FIG. 3B, or the like. In addition, the landing state determination unit determines whether or not a landing position in the sub-scanning direction deviates from the normal position with respect to a nozzle which draws the straight line 402 based on a position of the straight line 402 which is read using the landing position reading unit 14. In the determination, the landing state determination unit calculates an interval (pitch) of the straight line 402 in the sub-scanning direction between the straight line and a neighboring straight line 402, with respect to each of the plurality of straight lines 402 which align in the sub-scanning direction based on a position of the straight line 402 which is read using the landing position reading unit 14, similarly to the operation which is described with reference to FIG. 3B, or the like, for example. In addition, the landing state determination unit determines whether or not the landing position in the sub-scanning direction is deviated from the normal position with respect to the nozzle which draws each of the straight lines 402 based on a calculated interval.

For example, when a landing position of ink droplets is deviated in the sub-scanning direction in any of nozzles, a deviation occurs in an interval between a straight line and a neighboring straight line 402, like the straight line 402 to which a mark B is attached in FIG. 6A. In addition, as a result, as illustrated in FIG. 6B, a deviation occurs also at a position of a region with a certain density or more on a medium. For this reason, with such a configuration, it is possible to appropriately detect a deviation in landing position in the sub-scanning direction.

In addition, for example, when a landing position of ink droplets is deviated from the normal position, performing maintenance such as nozzle cleaning is taken into consideration. In addition, when a nozzle state is not recovered even when maintenance of a predetermined number of times is performed, performing a display of errors, warnings, or the like is also taken into consideration. In addition, determination of a landing position of ink droplets in the sub-scanning direction may be made at the same time as measuring of the line width of the straight line 402, for example.

Figure 7A:
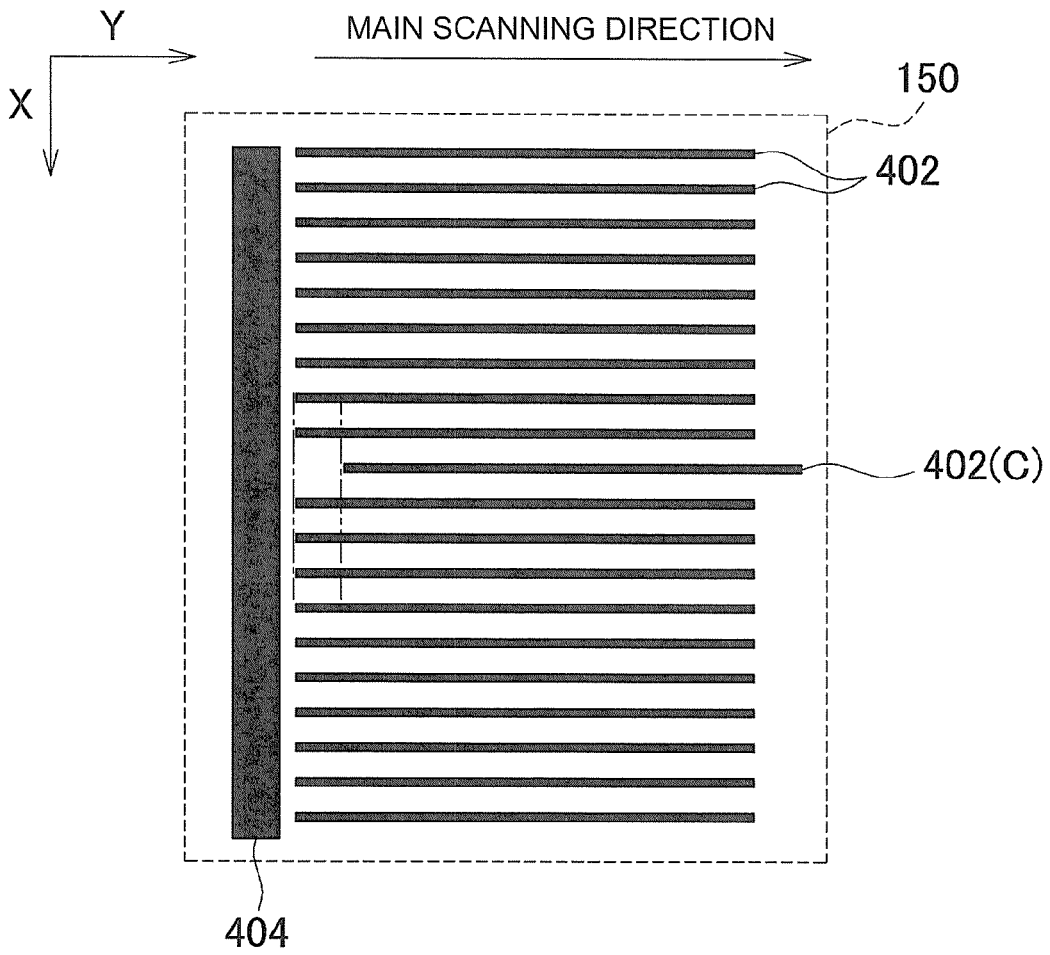
FIGS. 7A and 7B are diagrams which describe an example of operations which determine a landing position of ink droplets in the main scanning direction.
Figure 7B:
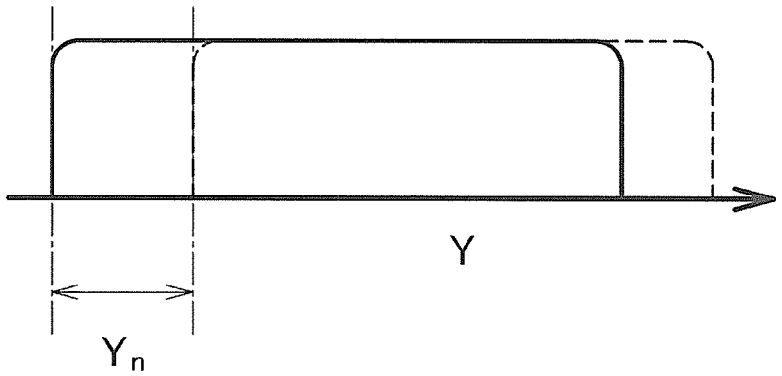

Subsequently, an example of operations of determining a landing position of ink droplets in the main scanning direction will be described. FIGS. 7A and 7B are diagrams which describe an example of operations which determine a landing position of ink droplets in the main scanning direction. FIG. 7A illustrates an example of the straight line 402 and the reference line 404 which are drawn at a time of determining a landing position. FIG. 7B illustrates an example of a reading result using the landing position reading unit 14.

As illustrated in FIG. 7A, according to the modification example, also in a case in which a landing position of ink droplets in the main scanning direction is determined, the plurality of straight lines 402 and the reference line 404 are drawn using the ink jet head. In addition, an image in the field of vision 150 including the plurality of straight lines 402 and the reference line 404 is imaged using the landing position reading unit 14 as the two-dimensional image sensor. In addition, as illustrated in FIG. 7B, determination of a landing position of ink droplets in the main scanning direction, or the like, is made based on the imaged image.

In addition, determination of a landing position of ink droplets in the main scanning direction is made by detecting a deviation in the main scanning direction with respect to a position at which the straight line 402 is printed, for example. More specifically, according to the modification example, when a landing position of ink droplets in the main scanning direction is determined, the landing position reading unit 14 detects a region with a certain density or more on a medium. For this reason, when the straight line 402 which extends in the main scanning direction is drawn, as illustrated in FIG. 7B, a signal in which a density close to a peak value is continuous by a length of the straight line 402 is obtained with respect to each of the straight lines 402.

In addition, in this case, for example, it is possible to detect whether or not there is deviation in the main scanning direction with respect to each of the straight lines 402 by detecting a difference in a position (delay of peak position, or the like) at which a density reaches the peak value with respect to a signal corresponding to each of the straight lines 402. In addition, in this manner, it is possible to determine whether or not a landing position in the main scanning direction is deviated from the normal position with respect to the nozzle which draws each of the straight lines 402.

For example, when a landing position of ink droplets is deviated in the main scanning direction in any of nozzles, a deviation in the main scanning direction occurs at a position of the straight line, like the straight line 402 to which a mark C is attached in FIG. 7A. In addition, as a result, as illustrated in FIG. 7B, a deviation corresponding to a delay of a peak position which is denoted by Yn in the figure also occurs at the peak position of a signal which is a measurement result. For this reason, with such a configuration, it is possible to appropriately detect a deviation in landing position in the main scanning direction, for example.

In addition, for example, when a landing position of ink droplets is deviated from the normal position, performing maintenance such as nozzle cleaning is taken into consideration. In addition, when a nozzle state is not recovered even when maintenance of a predetermined number of times is performed, performing a display of errors, warnings, or the like is also taken into consideration. Determination of a landing position of ink droplets in the main scanning direction may be made at the same time as measuring of the line width of the straight line 402, and as determination of a landing position of ink droplets in the sub-scanning direction, for example.

In addition, also in the modification example, it is possible to perform determination of a landing position of ink droplets in the main scanning direction using an operation similar to that in the printing apparatus 10 which is described with reference to FIGS. 1A to 3B, for example. For example, the dotted line 202 (refer to FIGS. 2A and 2B) may be drawn similarly to the operation described with reference to FIGS. 2A and 2B, and determination of a landing position of ink droplets in the main scanning direction may be made based on a position of the dot 302 (refer to FIGS. 2A and 2B) which configures the dotted line 202. In addition, in contrast to this, for example, determination of a landing position of ink droplets in the main scanning direction may be made similarly to the operation which is described with reference to FIGS. 7A and 7B in the printing apparatus 10 which is described with reference to FIGS. 1A to 3B.

Hitherto, the present invention has been described using embodiments. However, a technical range of the present invention is not limited to the range described in the above described embodiments. It is obvious to those skilled in the art that it is possible to add various changes or modifications to the above described embodiment. It is obvious from claims that the embodiment to which such changes or modifications are added is also included in the technical range of the present invention.

The present invention can be suitably used for a printing apparatus, for example.

What is claimed is:

1. A printing apparatus which performs printing by using an ink jet method, and the printing apparatus comprising:

an ink jet head, including a plurality of nozzles aligned in a sub-scanning direction which is orthogonal to a main scanning direction, and each of the plurality of nozzles ejecting a plurality of ink droplets toward a medium while moving in the main scanning direction to draws lines on the medium;

a landing position reading unit, which reads one or both of a line width of a line and a landing position by correlating each of the plurality of nozzles which ejects the plurality of ink droplets, and the landing position is a position on the medium where ink droplets are landed; and a landing state determination unit, which determines one or both of whether or not the line width is in a range of a standard which is set in advance and whether or not the landing position is deviated from a normal position which is set in advance with respect to each of the plurality of nozzles which ejects the ink droplets by comparing the landing positions with each other, based on the landing position which is read by using the landing position reading unit, in order to detect ejection abnormality of each of the plurality of nozzles.

2. The printing apparatus according to claim 1, wherein the ink jet head ejects ink droplets toward the medium from the nozzles by performing a main scanning operation in which ink droplets are ejected, while moving in the main scanning direction which is set in advance, and the ink jet head draws lines or dots on the medium by ejecting ink droplets from the nozzles, by performing the main scanning operation at a time of determining the landing position in which the landing state determination unit is caused to make a determination on the landing position, wherein the landing position reading unit reads a position of the lines or dots as the landing position, by correlating the position of the lines or dots with the nozzle which draws the lines or dots, and wherein the landing state determination unit determines whether or not the landing position is deviated from the normal position with respect to the nozzle which draws the lines or dots, based on the position of the lines or dots which is read by using the landing position reading unit.

3. The printing apparatus according to claim 2, wherein the landing position reading unit reads the position of the lines or dots in the main scanning direction as the landing position, and wherein the landing state determination unit determines whether or not the landing position in the main seaming direction is deviated from the normal position with respect to the nozzle which draws the lines or dots, based on the position of the lines or dots which is read by using the landing position reading unit.

4. The printing apparatus according to claim 3, wherein the ink jet head draws a plurality of lines or dots which align in the sub-scanning direction on the medium by drawing the lines or dots on the medium using each of the plurality of nozzles aligning in the sub-scanning direction at a time of determining the landing position, wherein the landing position reading unit reads positions of each of the plurality of lines or dots in the main scanning direction by correlating the positions with each of the nozzles which draws the lines or dots, and wherein the landing state determination unit determines whether or not the landing position in the main scanning direction is deviated from the normal position with respect to each of the nozzles which draws the lines or dots, by comparing each of the positions of the plurality of lines or dots with each other based on the positions of the plurality of lines or dots which are read by the landing position reading unit in the main scanning direction.

5. The printing apparatus according to claim 2, wherein the ink jet head draws a straight line which extends in the main scanning direction by ejecting ink droplets from the nozzles using a main scanning operation at the time of determining the landing position, wherein the landing position reading unit reads a position of the straight line in the sub-scanning direction which is orthogonal to the main scanning direction as the landing position, and wherein the landing state determination unit determines whether or not the landing position in the sub-scanning direction is deviated from the normal position with respect to the nozzle which draws the straight line, based on the position of the straight line which is read by using the landing position reading unit.

6. The printing apparatus according to claim 2, further comprising:

a line width measuring unit, which measures a line width of a line which is drawn on the medium at the time of determining the landing position.

7. The printing apparatus according to claim 2, wherein the ink jet head includes a plurality of nozzles which align in the sub-scanning direction which is orthogonal to the main scanning direction, and the ink jet head draws lines or dots on a medium by using selected nozzles which are a part of nozzles selected from the plurality of nozzles at the time of determining the landing position, wherein the selected nozzles are selected so as to interpose at least one or more non-selected nozzles therebetween in a nozzle column direction, and wherein the landing position reading unit reads the position of lines or dots which are drawn using the selected nozzle, by correlating the position with the nozzle which draws the lines or dots.

8. The printing apparatus according to claim 2, wherein the landing position reading unit is a sensor which moves in the main scanning direction along with the ink jet head in the main scanning operation.

9. The printing apparatus according to claim 2, wherein the ink jet head performs a main scanning operation which ejects ink droplets while moving in the main scanning direction which is set in advance, and wherein the landing position reading unit is a one-dimensional image sensor which images a linear region which extends in the sub-scanning direction which is orthogonal to the main scanning direction.

10. The printing apparatus according to claim 2, wherein the landing position reading unit is a two-dimensional image sensor which images a planar region on the medium.

11. The printing apparatus according to claim 2, further comprising:

a maintenance unit, which performs maintenance of the ink jet head, wherein the maintenance unit performs maintenance of the ink jet head when the landing state determination unit determines that the landing position is deviated from the normal position which is set in advance.

12. The printing apparatus according to claim 1, further comprising:

a line width measuring unit, which measures a line width of a line which is drawn on the medium at the time of determining the landing position, wherein the landing state determination unit further determines whether or not the line width, which is measured by using the line width measuring unit, is in a range of a standard which is set in advance.

13. The printing apparatus according to claim 1, wherein the ink jet head performs a main scanning operation which ejects ink droplets while moving in the main scanning direction which is set in advance, and wherein the landing position reading unit is a one-dimensional image sensor which images a linear region which extends in the sub-scanning direction which is orthogonal to the main scanning direction.

14. The printing apparatus according to claim 1, wherein the landing position reading unit is a two-dimensional image sensor which images a planar region on the medium.

15. The printing apparatus according to claim 1, further comprising:

a maintenance unit, which performs maintenance of the ink jet head, wherein the maintenance unit performs maintenance of the ink jet head when the landing state determination unit determines that the landing position is deviated from the normal position which is set in advance.

16. A landing position determination method which determines whether or not a landing position toward a medium on which ink droplets are landed is deviated from a normal position which is set in advance, in a printing apparatus which performs printing by using an ink jet method, and the landing position determination method comprising:

ejecting ink droplets toward the medium from a plurality of nozzles of an ink jet head, wherein the plurality of nozzles is aligned in a sub-scanning direction which is orthogonal to a main scanning direction, and each of the plurality of nozzles ejecting a plurality of ink droplets toward the medium while moving in the main scanning direction to draws lines on the medium;

reading the landing position of ink droplets by using a landing position reading unit, wherein the landing position reading unit reads one or both of a line width of a line and the landing position by correlating each of the plurality of nozzles which ejects the plurality of ink droplets, and the landing position is a position on the medium where ink droplets are landed; and determining one or both of whether or not the line width is in a range of a standard which is set in advance and whether or not the landing position is deviated from the normal position which is set in advance with respect to each of the plurality of nozzles which ejects the ink droplets by comparing the landing positions with each other, based on the landing position which is read by using the landing position reading unit, in order to detect ejection abnormality of each of the plurality of nozzles.

* * * * *